US009242465B2

(12) United States Patent
Owaku et al.

(10) Patent No.: US 9,242,465 B2
(45) Date of Patent: Jan. 26, 2016

(54) CHANNEL STRUCTURE, LIQUID EJECTING HEAD AND LIQUID EJECTING APPARATUS

(71) Applicant: Seiko Epson Corporation, Shinjuku-ku (JP)

(72) Inventors: Takeshi Owaku, Shiojiri (JP); Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/619,545

(22) Filed: Feb. 11, 2015

(65) Prior Publication Data

US 2015/0224769 A1 Aug. 13, 2015

(30) Foreign Application Priority Data

Feb. 13, 2014 (JP) ..... 2014-025483

(51) Int. Cl.
*B41J 2/14* (2006.01)

(52) U.S. Cl.
CPC ..... *B41J 2/1433* (2013.01); *B41J 2/1404* (2013.01)

(58) Field of Classification Search
CPC .... B41J 2/135; B41J 2/14016; B41J 2/14032; B41J 2/1404; B41J 2/14064; B41J 2/14201
See application file for complete search history.

(56) References Cited

U.S. PATENT DOCUMENTS

2004/0246313 A1* 12/2004 Lim et al. ..... 347/68
2012/0212547 A1* 8/2012 Takemoto et al. ..... 347/70

FOREIGN PATENT DOCUMENTS

JP 2012-206424 A 10/2012
JP 2012-218195 A 11/2012

* cited by examiner

*Primary Examiner* — Geoffrey Mruk
(74) *Attorney, Agent, or Firm* — Kilpatrick Townsend & Stockton LLP

(57) ABSTRACT

A liquid ejecting head includes a first casing, a second casing, a seal member and a valve assembly. The first casing is fixed to the second casing with the seal member therebetween. A storage space is created in the first casing and the second casing. The valve assembly is accommodated in the storage space and forms a channel along which liquid flows. The valve assembly is fixed to the first casing and separated from the second casing.

6 Claims, 3 Drawing Sheets

CHANNEL STRUCTURE, LIQUID EJECTING HEAD AND LIQUID EJECTING APPARATUS

This application claims priority to Japanese Patent Application No. 2014-025483, filed Feb. 13, 2014, the entirety of which is hereby incorporated by reference.

BACKGROUND

1. Technical Field

The present invention relates to the manufacturing of a structure including a channel along which liquid flows.

2. Related Art

To date, several configures in which components (referred to below as "channel forming sections") forming a channel along which liquid flows are housed in a casing have been proposed. For example, JP-A-2012-206424 and JP-A-2012-218195 disclose a configuration as exemplified in FIG. 6. In this configuration, a base section 92 is fixed to a cover section 94 by a plurality of screws 96 with a seal member 90 made of an elastic material therebetween. In addition, a channel unit 98 including an adjusting valve and a filter is formed in the inner space of the configuration. The channel unit 98 is a channel forming section in which a plurality of channel members 982 are stacked. By fixing the base section 92 to the cover section 94 such that the seal member 90 is sufficiently pressed and shrunk, the evaporation of moisture in the inner space is prevented.

SUMMARY

In the configuration exemplified in FIG. 6, the base section 92 is fixed to the cover section 94 while the upper and lower surfaces of the channel unit 98 are in contact with the cover section 94 and the base section 92, respectively. In this case, the distance between the base section 92 and the cover section 94 (the deformation amount of the seal member 90) depends on the height H of the channel unit 98. Accordingly, a variation in the height H of the channel unit 98 (manufacturing and assembly errors of the channel members 982) leads to a distance error between the base section 92 and the cover section 94. Because of this distance error, the capacities of individual seal members 90 to evaporate moisture may disadvantageously vary. An advantage of some aspects of the invention is that a relative position between a first casing and a second casing that house a channel forming section can be set precisely.

According to a first aspect of the invention, a channel structure includes a first casing, a second casing, a seal member and a channel forming section. The first casing is fixed to the second casing with the seal member therebetween, and a storage space is created in the first casing and the second casing. The channel forming section is fixed to one of the first and second casings and separated from the other of the first and second casings. In the above configuration, the channel forming section fixed to one of the first and second casings is separated from the other of the first and second casings. It is thus advantageous to determine precisely a relative position between the first and second casings (more specifically, the deformation amount of the seal member) independently of the channel forming section. Here, the expression "the channel forming section is separated from the first or second casing" indicates a state where one of the channel forming section and the first casing (or second casing) do not press the other. Therefore, the concept "separated" applies to a state where the channel forming section and the first or second casing are located at a preset spacing as well as a state where the channel forming section and the first or second casing are in contact with each other (at no spacing) while one of the channel forming section and the first or second casing do not press the other.

If a channel forming section includes a plurality of channel members stacked in a direction from a first casing to a second casing, there are cases where the channel members are deformed (thermally deformed) and vary in size during molding and bonding processes in assembling. Accordingly, if a channel forming section is in contact with both a first casing and a second casing, an error of a relative position between the first and second casings may be prominent and non-negligible. In the light of this, the first aspect of the invention is especially suitable for a configuration in which a channel forming section includes a plurality of channel members stacked in a direction from a first casing to a second casing. Moreover, when the plurality of channel members are each made of a resin material and bonded to one another with a binder, an error of a relative position between the first and second casings may be further prominent due to the channel forming section. Therefore, the first aspect of the invention is especially suitable for a configuration in which a plurality of channel members each made of a resin material are bonded to one another with a binder.

The above channel structure preferably includes an elastic body disposed between the channel forming section and the other of the first and second casings. By disposing the elastic body between the channel forming section and the first or second casing, the position of the channel forming section is maintained in a storage space with high stability.

In the above aspect, although the channel structure may have any given function and configuration, it is applicable to liquid ejecting heads that discharge a liquid that has flowed along a channel through a nozzle. According to a second aspect of the invention, a liquid ejecting head includes a first casing, a second casing, a seal member, a channel forming section and a head unit. The first casing is fixed to the second casing with the seal member therebetween, and a storage space is created in the first and second casings. The channel forming section is accommodated in the storage space and forms a channel along which a liquid flows. The head unit discharges the liquid that has flowed along the channel through a nozzle. The channel forming section is fixed to one of the first and second casings and separated from the other of the first and second casings. The liquid ejecting head configured above provides the same function and effect as the channel structure described above.

According to a third aspect of the invention, the liquid ejecting apparatus includes the liquid ejecting head according to the second aspect. This liquid ejecting apparatus is applicable appropriately to print apparatuses that discharge inks, but its application is not limited to such print apparatuses.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
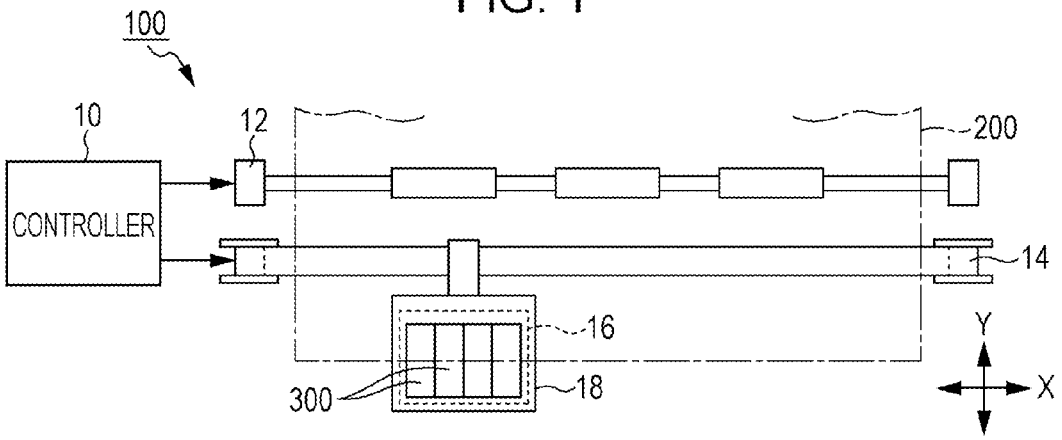
FIG. 1 illustrates a configuration of a printer in a first embodiment of the invention.

FIG. 1 illustrates a partial configuration of an inkjet type printer 100 in the first embodiment of the invention. The printer 100 is a liquid ejecting apparatus that forms an image on a surface of a print medium 200 such as printing paper by discharging ink, which is an example of liquid, onto this surface. Specifically, as exemplified in FIG. 1, the printer 100 includes a controller 10, a transport mechanism 12, a movement mechanism 14, a liquid ejecting head 16 and a carriage 18.

The controller 10 collectively controls the individual components of the printer 100. The liquid ejecting head 16 is mounted in the carriage 18 together with a plurality of ink cartridges 300 filled with inks. This liquid ejecting head 16 discharges the inks supplied from the ink cartridges 300 onto the print medium 200 through a plurality of nozzles N under the control of the controller 10. The transport mechanism 12 transports the print medium 200 in the Y direction (sub-scanning direction) under the control of the controller 10. The movement mechanism 14 reciprocates the carriage 18 in the X direction (main scanning direction) under the control of the controller 10. The liquid ejecting head 16 discharges the inks onto the print medium 200 during the transportation of the print medium 200 and the reciprocation of the carriage 18, forming a desired image on the print medium 200.

Figure 2:
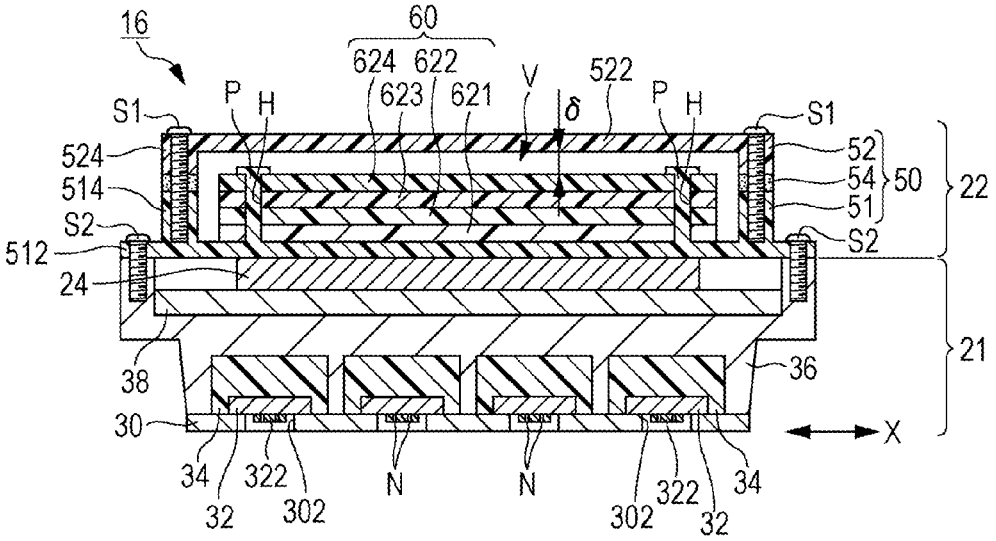
FIG. 2 illustrates a cross section of the liquid ejecting head.

FIG. 2 illustrates a cross section of the liquid ejecting head 16 (in the vertical direction to the Y direction). The liquid ejecting head 16 includes a first structure 21, a second structure 22 and a communicating section 24. The first structure 21 discharges the inks through the nozzles N; the second structure 22 supplies the inks from the ink cartridges 300 to the first structure 21. Channels in the first structure 21 communicate with the corresponding channels in the second structure 22 through the communicating section 24. Note that specific structures of the ink-flow channels formed in the first structure 21 and the second structure 22 are not illustrated for the sake of simplicity.

Figure 3:
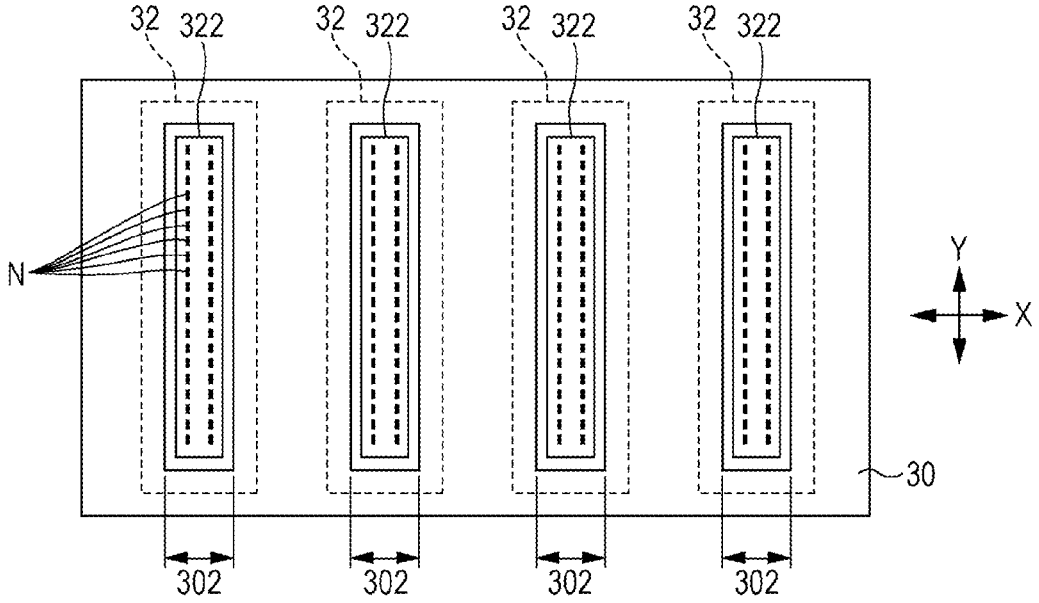
FIG. 3 illustrates the liquid ejecting head as seen from the print medium.

The first structure 21 includes a fixed plate 30, a plurality of head units 32, a plurality of support sections 34, a case member 36 and a control substrate 38. FIG. 3 illustrates the first structure 21 as seen from the print medium 200 (or as seen from the side on which inks are discharged). As exemplified in FIGS. 2 and 3, each head unit 32 is a head chip that discharges an ink through nozzles N. An arbitrary one of the head units 32 includes: a nozzle plate 322 in which nozzles N are arranged in two lines; and a plurality of pairs of pressure chamber and piezoelectric element (not illustrated) that correspond to different nozzles N. The piezoelectric elements vibrate in response to the reception of drive signals, varying the inner pressures of the pressure chambers. As a result, inks filled in the pressure chambers are discharged through the nozzles N. Note that each head unit 32 may employ any given structure.

The fixed plate 30 is a flat-plate member made of, for example, a highly rigid metal (e.g., stainless steel) and has a plurality of openings 302 formed so as to correspond to the head units 32. As exemplified in FIG. 3, the head units 32 are fixed to the surface of the fixed plate 30 with, for example, a binder while the nozzle plates 322 are positioned within the corresponding openings 302. Furthermore, the head units 32 are arrayed in the X direction so that the nozzles N in each head unit 32 are arrayed in the Y direction. The support sections 34, for example, each made of a resin material, support the corresponding head units 32. A reservoir that stores an ink to be supplied to a corresponding head unit 32 and a channel through which the ink is supplied to the reservoir are formed in each support section 34. The case member 36 supports the support sections 34 (head units 32) and the control substrate 38, and forms the channels through which the inks are supplied to the head units 32.

The control substrate 38 is a wiring substrate on which wires used to supply drive signals to the head units 32 and apply power supply potentials thereto and a drive circuit that generates the drive signals are mounted. Through a flexible substrate (not illustrated) disposed between the control substrate 38 and the head units 32, the control substrate 38 supplies the drive signals to the head units 32 and applies the power supply potentials thereto. The channels in the communicating section 24 communicate with the corresponding channels in the case member 36 via through-holes (not illustrated) formed in the control substrate 38.

As exemplified in FIG. 2, the second structure 22 is a channel structure that includes a casing 50 and a valve assembly 60. The casing 50 is a hollow case that includes a first casing 51, a second casing 52 and a seal member 54. The seal member 54 is a rectangular elastic body that fits the exteriors of the first casing 51 and the second casing 52. The first casing 51 is positioned below the second casing 52 in the vertical direction (between the second casing 52 and the first structure 21). The second casing 52 may also be regarded as a lib member that closes the opening of the first casing 51. The first casing 51 is fixed to the second casing 52 with the seal member 54 therebetween, creating an inner space V (referred to below as a "storage space V"). In the first embodiment, the first casing 51 is fixed to the second casing 52 by a plurality of screws S1.

The first casing 51 is a structure shaped so as to include a flat surface section 512 and a side surface section 514 and integrally formed by, for example, subjecting a resin material to injection molding. The flat surface section 512 is a flat part molded in a substantially rectangular shape. The side surface section 514 is a wall part that protrudes from the flat surface section 512 toward the second casing 52 and has a substantially rectangular shape in plan view (as seen from a direction perpendicular to the flat surface section 512). The case member 36 of the first structure 21 is fixed to the first casing 51 (flat surface section 512) of the second structure 22 by a plurality of screws S2. When the first structure 21 is fixed to the second structure 22, the communicating section 24 is pressed from both sides by the case member 36 and the first casing 51 and retained therebetween.

The valve assembly 60 is a channel forming section (channel unit) that forms channels through which the inks flow. This valve assembly 60 is accommodated and supported in the storage space V surrounded by the first casing 51, the second casing 52 and the seal member 54. The valve assembly 60 in the first embodiment includes a plurality of (four) channel members 621 to 624 stacked in a direction from the first casing 51 to the second casing 52. Each of the channel members 621 to 624 is a flat-plate member formed by, for example, subjecting a resin material to injection molding. Stacking the channel members 621 to 624 in this manner forms ink-flow channels and adjusting valves in the valve assembly 60. Each adjusting valve is a component (e.g., a self-sealing valve or a backpressure control valve) that controls the pressure of an ink supplied from, for example, a corresponding ink cartridge 300. The inks filled in the ink cartridges 300 are supplied to the valve assembly 60 through an opening (not illustrated) of the casing 50, then pass through the channels of the valve assembly 60, and flow into the first structure 21 (head units 32).

The valve assembly 60 is fixed to the first casing 51. In the first embodiment, the valve assembly 60 is fixed to the flat surface section 512 of the first casing 51. In order to fix the valve assembly 60 to the first casing 51, bonding and swaging processes may be used. More specifically, as exemplified in FIG. 2, pins (swaged pins) P are formed on the flat surface section 512 of the first casing 51. In addition, through-holes H into which the pins P are to be inserted are formed in the channel members 621 to 624 in the valve assembly 60. The valve assembly 60 is fixed to the first casing 51 by binding the channel member 621, or the lowermost layer, to the flat surface section 512 with a binder and then swaging (e.g., thermally swaging) the ends of the pins P inserted into the through-holes H so as to be deformed. The channel members 621 to 624 in the valve assembly 60 are also fixed to one another by being bonded with a binder and the swaging of the pins P.

The second casing 52 of the casing 50 is a structure shaped so as to include a flat surface section 522 and a side surface section 524 and is integrally formed by, for example, subjecting a resin material to injection molding. Alternatively, the second casing 52 (or the first casing 51) and the seal member 54 may be integrally formed with two-color molding. The flat surface section 522 is a part that faces the flat surface section 512 of the first casing 51 with the valve assembly 60 therebetween. The side surface section 524 is a wall-shaped part that protrudes from the periphery of the flat surface section 522 toward the first casing 51 and is formed in a substantially rectangular shape in planar view, like the side surface section 514 of the first casing 51. The screws S1 are inserted into fixing holes in the side surface section 524 of the second casing 52 and the side surface section 514 of the first casing 51 while the seal member 54 is disposed between the top surface of the side surface section 514 of the first casing 51 and the bottom surface of the side surface section 524 of the second casing 52. In this way, the first casing 51 is fixed to the second casing 52. While the first casing 51 is fixed to the second casing 52, the seal member 54 is maintained in a deformed (pressed and shrunk) state therebetween. More specifically, the seal member 54 is deformed appropriately, namely, to the extent that the evaporation of moisture in the storage space V is sufficiently prevented.

In the first embodiment, when the first casing 51 is fixed to the second casing 52, the valve assembly 60 fixed to the first casing 51 is separated from the second casing 52. More specifically, assume that the surface of the channel member 624 (uppermost layer) in the valve assembly 60 which is closer to the flat surface section 522 of the second casing 52 is a first surface, and the surface of the flat surface section 522 in the second casing 52 which is closer to the first casing 51 is a second surface. As can be understood from FIG. 2, the first and second surfaces face each other with a spacing 6 (gap) therebetween. Thus, when the second casing 52 is fixed to the first casing 51, it does not make contact with the valve assembly 60.

In the first embodiment described above, a first casing 51 and a second casing 52 create a storage space V, and a valve assembly 60 is accommodated in this storage space V. Further, the valve assembly 60 is fixed to the first casing 51 and separated from the second casing 52. According to this configuration, since the second casing 52 is not in contact with the valve assembly 60, it is possible to determine precisely a relative position between the first casing 51 and the second casing 52 independently of the presence of the valve assembly 60. It is thus advantageous to set precisely a deformation amount of a seal member 54 between the first casing 51 and the second casing 52 such that the function of evaporating moisture in a casing 50 is reliably fulfilled.

If a valve assembly 60 is formed of a plurality of channel members 621 to 624 stacked in a direction from a first casing 51 to a second casing 52 as exemplified in FIG. 2, a variation in the height of the valve assembly 60 tends to be prominent because manufacturing errors of the respective stacked channel members 621 to 624 are added to one another. In particular, when the valve assembly 60 is in contact with the second casing 52, a distance error between the first casing 51 and the second casing 52 is non-negligible. The first embodiment is effective for a configuration in which a valve assembly 60 is formed of a plurality of stacked channel members 621 to 624, because it can reduce a distance error between a first casing 51 and a second casing 52 by separating the valve assembly 60 from the second casing 52. As can be understood from the above description, when a valve assembly 60 (channel forming section) is formed of a plurality of stacked channel members 62, a configuration in which the valve assembly 60 is not in contact with a second casing 52 is highly effective.

If a valve assembly 60 is formed by bonding a plurality of channel members 621 to 624 each made of a resin material to one another with a binder, there are cases where the channel members 621 to 624 are deformed (typically thermally deformed) and vary in size during molding and bonding processes in assembling. In this case, a variation in the height of the valve assembly 60 tends to be prominent. Therefore, if a valve assembly 60 is in contact with a second casing 52, a distance error between a first casing 51 and the second casing 52 is non-negligible. The first embodiment is effective for a configuration in which a valve assembly 60 is formed by bonding a plurality of channel members 621 to 624 each made of a resin material to one another with a binder, because it can reduce a distance error between a first casing 51 and a second casing 52 by separating the valve assembly 60 from the second casing 52. As can be understood from the above description, when a plurality of channel members 62 each made of a resin material are fixed to one another with a binder, a configuration in which a valve assembly 60 is not in contact with a second casing 52 is highly effective.

Second Embodiment

A second embodiment of the invention will be described. Of components that will be described below, ones that have the same effects and functions as those in the first embodiment are given the same reference numerals, and detailed descriptions thereof will be skipped as appropriate.

Figure 4:
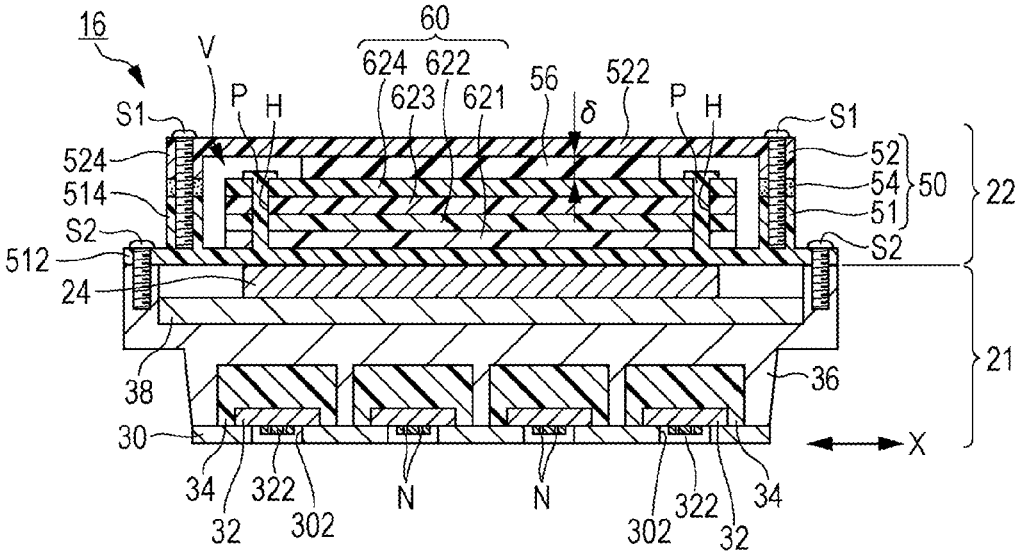
FIG. 4 illustrates a cross section of a liquid ejecting head in a second embodiment of the invention.

FIG. 4 illustrates a cross section of a liquid ejecting head 16 in the second embodiment and corresponds to FIG. 2 to which reference has been made to describe the first embodiment. As exemplified in FIG. 4, the liquid ejecting head 16 in the second embodiment has an elastic body 56 in addition to the configuration in the first embodiment. This elastic body 56 is a film (sheet) or plate shaped member made of an elastic material (e.g., elastomer) and disposed between a second casing 52 and a valve assembly 60. More specifically, one (upper) surface of the elastic body 56 is in contact with the surface of a flat surface section 522 of the second casing 52, whereas the other (lower) surface of the elastic body 56 is in contact with a channel member 624 of the valve assembly 60 which is located close to the second casing 52.

The second embodiment configured above produces the same effect as the first embodiment. Specifically, in the second embodiment, the elastic body 56 is disposed between the second casing 52 and the valve assembly 60. This elastic body 56 presses and urges the valve assembly 60 toward a first casing 51. This can advantageously maintain the position of the valve assembly 60 in a storage space V with higher stability than the first embodiment. Moreover, in the second embodiment, a swaging structure using pins P may not be used because the position of the valve assembly 60 is maintained with high stability by the elastic body 56 as described above.

Third Embodiment

Figure 5:
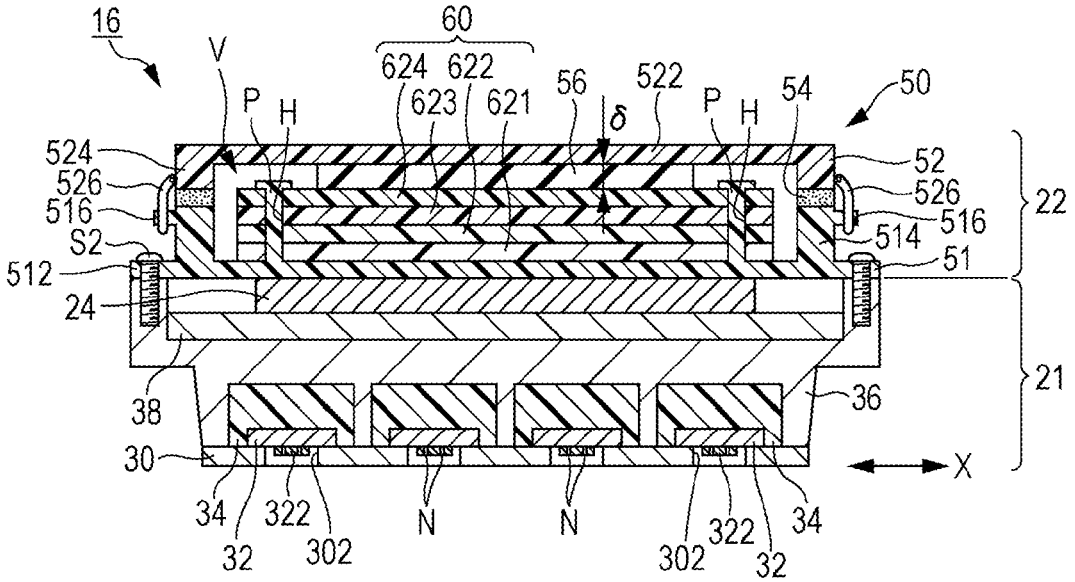
FIG. 5 illustrates a cross section of a liquid ejecting head in a third embodiment of the invention.
Figure 6:
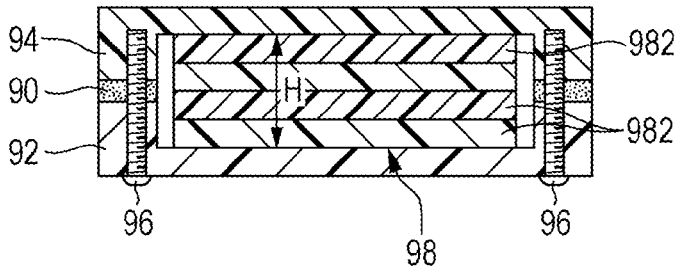
FIG. 6 PRIOR ART
FIG. 6 illustrates a cross section of a liquid ejecting head of prior art.

FIG. 5 illustrates a cross section of a liquid ejecting head 16 in a third embodiment. In the first embodiment described above, the first casing 51 is fixed to the second casing 52 of the casing 50 by the plurality of screws S1. In the third embodiment, however, a first casing 51 is fixed to a second casing 52 with a mechanism different from that of the first embodiment.

As exemplified in FIG. 5, a plurality of projecting sections 516 are formed on the outer surface of a side surface section 514 in the first casing 51; a plurality of mating (hook) sections 526 that correspond to the projecting sections 516 are formed on the outer surface of a side surface section 524 in the second casing 52. By rotating the mating sections 526 to mate with the corresponding projecting sections 516, the first casing 51 is fixed to the second casing 52. Alternatively, the projecting sections 516 may be formed in the second casing 52 and the mating sections 526 may be formed in the first casing 51. The third embodiment configured above produces the same effect as the first embodiment.

Modifications

The embodiments described above may be modified in various ways. Specific modifications will be described below. Two or more modifications selected from the following modifications may be combined as appropriate unless they are inconsistent with one another.

(1) In each embodiment described above, the valve assembly 60 is accommodated in the storage space V created by both the first casing 51 and the second casing 52. However, there is no limitation on components accommodated in the storage space V. For example, a filter assembly in which filters that remove bubbles and foreign matter from the inks passing therethrough are arranged between a plurality of channel members may be accommodated in the storage space V instead of (or together with) the valve assembly 60. In this example, the filter assembly is fixed to the first casing 51 and separated from the second casing 52, similar to the valve assembly 60. As can be understood from this example, objects accommodated in the storage space V created by both the first casing 51 and the second casing 52 are represented collectively by a component (channel forming section) forming a channel along which liquid flows. A specific function and structure of the channel forming section are not limiting; the valve assembly 60 and the filter assembly described above are regarded as preferred examples of the channel forming section.

(2) In each embodiment described above, the valve assembly 60 is fixed to the first casing 51 by the (thermal) swaging method using the pins P. However, there is no limitation on a method of fixing the valve assembly 60 (channel forming section) to the first casing 51. For example, a method that uses a binder, a plurality of screws or a combination thereof may be employed in order to fix the valve assembly 60 to the first casing 51.

(3) In each embodiment described above, the valve assembly 60 is fixed to the first casing 51 and separated from the second casing 52. However, the valve assembly 60 may be fixed to the second casing 52 and separated from the first casing 51. As can be understood from this example, each embodiment described above includes a configuration in which the channel forming section such as the valve assembly 60 is fixed to one of the first casing 51 and the second casing 52 and separated from the other.

(4) A method of discharging ink from the liquid ejecting head 16 is not limited to the method using piezoelectric elements (piezoelectric method). For example, the invention may be applied to a liquid ejecting head 16 that employs a thermal method using heating elements in which bubbles generated in a pressure chamber due to heating change the inner pressure. Moreover, the printer 100 in each embodiment described above exemplifies a serial type printer in which a liquid ejecting head 16 mounted in a carriage 18 reciprocates. However, the invention is also applicable to a line type printer in which a plurality of liquid ejecting heads 16 are arrayed along the width of a print medium 200 (in the Y direction).

(5) Exemplary applications of the printer 100 in each embodiment described above include print, facsimile, copy and other similar apparatuses. In other words, applications of the printer 100 are not limited to printers. More specifically, to give an example, if the printer 100 is equipped with a function of discharging colored liquids, it is applicable to apparatuses that manufacture color filters for liquid crystal displays. To give another example, if the printer 100 is equipped with a function of discharging conductive liquids, it is applicable to apparatuses that manufacture wires and electrodes on wiring substrates.

What is claimed is:

1. A channel structure comprising:

a first casing;

a second casing;

a seal member, the first casing being fixed to the second casing with the seal member therebetween, a storage space being created between the first and second casings; and a channel unit accommodated in the storage space, the channel unit including a channel along which a liquid flows, wherein the channel unit is fixed to one of the first and second casings and separated from the other of the first and second casings, and wherein the channel unit is fixed to a first surface of the one of the first and second casings, and wherein the channel extends alongside of the first surface of the one of the first and second casings.

2. The channel structure according to claim 1, wherein the channel unit includes a plurality of channel members stacked in a direction from the first casing to the second casing.

3. The channel structure according to claim 2, wherein the plurality of channel members are each made of a resin material and fixed to one another with a binder.

4. The channel structure according to claim 1, further comprising an elastic body disposed between the channel forming section and the other of the first and second casings.

5. A liquid ejecting head comprising:

a first casing;

a second casing;

a seal member, the first casing being fixed to the second casing with the seal member therebetween, a storage space being created between the first and second casings;

a channel unit accommodated in the storage space, the channel unit including a channel along which a liquid flows; and a head unit that discharges the liquid that has flowed along the channel through a nozzle, wherein the channel unit is fixed to one of the first and second casings and separated from the other of the first and second casings, and wherein the channel unit is fixed to a first surface of the one of the first and second casings, and wherein the channel extends alongside of the first surface of the one of the first and second casings.

6. A liquid ejecting apparatus comprising the liquid ejecting head according to claim 5.

* * * * *